United States Patent [19]

Rosevear

[11] Patent Number: 4,669,891

[45] Date of Patent: Jun. 2, 1987

[54] AREA CODE TWILIGHT CLOCK

[76] Inventor: John M. Rosevear, 225 East St., Milford, Mich. 48042

[21] Appl. No.: 875,967

[22] Filed: Jun. 19, 1986

[51] Int. Cl.[4] ..... G04B 19/22

[52] U.S. Cl. ..... 368/21; 368/223; 368/10

[58] Field of Search ..... 368/21, 22, 23, 24, 368/25, 26, 27, 15–19, 223, 228

[56] References Cited

U.S. PATENT DOCUMENTS

| | | | |
|---|---|---|---|
| 8,070 | 9/1909 | Curties | 368/27 |
| 4,253,169 | 2/1981 | Salah | 368/328 |
| 4,479,722 | 10/1984 | Salah | 368/329 |
| 4,502,789 | 3/1985 | Heath | 368/27 |
| 4,579,460 | 3/1986 | Shannon | 368/27 |

*Primary Examiner*—Bernard Roskoski

*Attorney, Agent, or Firm*—Reising, Ethington, Barnard, Perry & Milton

[57] ABSTRACT

The assembly includes a keyboard (16) for operator selection of the area code or airport designation of a geographical location. A memory means (20) contains information of sunrise time, sunset time and twilight duration for each area code or airport designation selected. A counter means (30) updates and stores codes representative of the time and date. A demultiplexer (47), registers (44) and a register counter (49) accumulates the data from the keyboard and from the months (48) and days (42) counters to be sent to the memory means (20) to be decoded for selection of the necessary information. A program control (50), such as a microprocessor, accumulates the data from the memory means (20) and counter means (30) to generate a signal to and present on the video display screen (12) parallel vertical sections (60, 62, 64) representing juxtaposed hours of the day at the selected geographical location including each of light, dark and twilight hours.

14 Claims, 2 Drawing Figures

AREA CODE TWILIGHT CLOCK

TECHNICAL FIELD

The subject invention relates to a clock like instrument which is used to indicate light-in-the sky time with respect to natural luminosity conditions of a geographical location.

BACKGROUND ART

Prior clock systems include time indicating devices to indicate sunrise and sunset times dependent upon global geographical locations. It is frequently desirable to be able to know the time of sunrise and sunset in a specified geographical location now that world wide travel and relations have expanded. As an example, a travel agency may use such a clock system due to the fact that travelers frequently want to be advised on light conditions at their destination to plan arrival or departure times to and from a different geographical location.

There are clock systems known in the prior art where daylight conditions can be indicated dependent on geographical location. The prior art systems have been based on mechanically rotated devices, such as a globe, or graphing devices to determine the daylight conditions dependent upon date and geographical location.

One type of a global device includes a rotating circular globe, a stationary cap, and a lighting means within the globe to illuminate half of the globe at a time representative of light conditions. A stationary arrow extends from the cap, wherein it is set in a notch indicating a time zone. The arrow extends to the equator of the globe which indicates time. The globe will rotate causing a result in change of time indicated by the arrow and change in light conditions of a particular location. The U.S. Pat. No. 3,516,243 granted June 23, 1970 in the name of Allyn B. Hazard, discloses a global system which uses a rotating globe with a stationary light means and time arrow. An inadequacy of this type of system is that the change in light conditions between light and dark is dependent upon month only, and indicates only an abrupt change from light to dark, and vise versa.

Another graphing device uses a clock face with disks in the center which can be rotated. A map of the United States is used in conjunction with the clock to determine longitude and latitude data which is transformed into minutes to apply when rotating the center disk. An arc is used to represent the month, wherein the exact date of location is to be estimated within the arc. By drawing a line through from the center point through the arc, sunrise and sunset times are indicated. The U.S. Pat. No. 4,551,027 granted Nov. 5, 1985 in the name of George T. Spruck discloses a graphing system wherein a rotating disc clock is used in conjunction with a geographical map to determine sunrise and sunset times in a specified geographical locations. An inadequacy of this system is the necessity of two references which when used together will determine only sunrise and sunset times.

SUMMARY OF THE INVENTION AND ADVANTAGES

The subject invention relates to an display system for displaying the daylight conditions of a geographical location. This system includes a display screen and memory means for storing information including the beginning and ending of twilight at sunrise and sunset for each calendar day of the year for various geographical locations. A control means is included for selecting a geographical location and retrieving the information from the memory means to generate a signal to the display to present on the display screen parallel vertical sections representing juxtaposed hours of the day at the selected geographical location including each of light and dark and twilight hours.

The present invention solves the inadequacies of the prior art by indicating time with respect to sunrise time, sunset time and twilight duration in a specified geographical location based on the day of the year with the use of a single device.

BRIEF DESCRIPTIONS OF THE DRAWINGS

Other advantages of the present invention will be readily appreciated as the same becomes better understood by reference to the following detailed description when considered in connection with the accompanying drawings wherein:

FIG. 1 is a perspective view of the preferred embodiment of a subject invention; and FIG. 2 is a block diagram of the control circuit of the subject invention.

DESCRIPTION OF THE PREFERRED EMBODIMENT

An electronic display system for displaying the daylight conditions of a geographical location selected by telephone area code is generally shown at 10.

Figure 2:
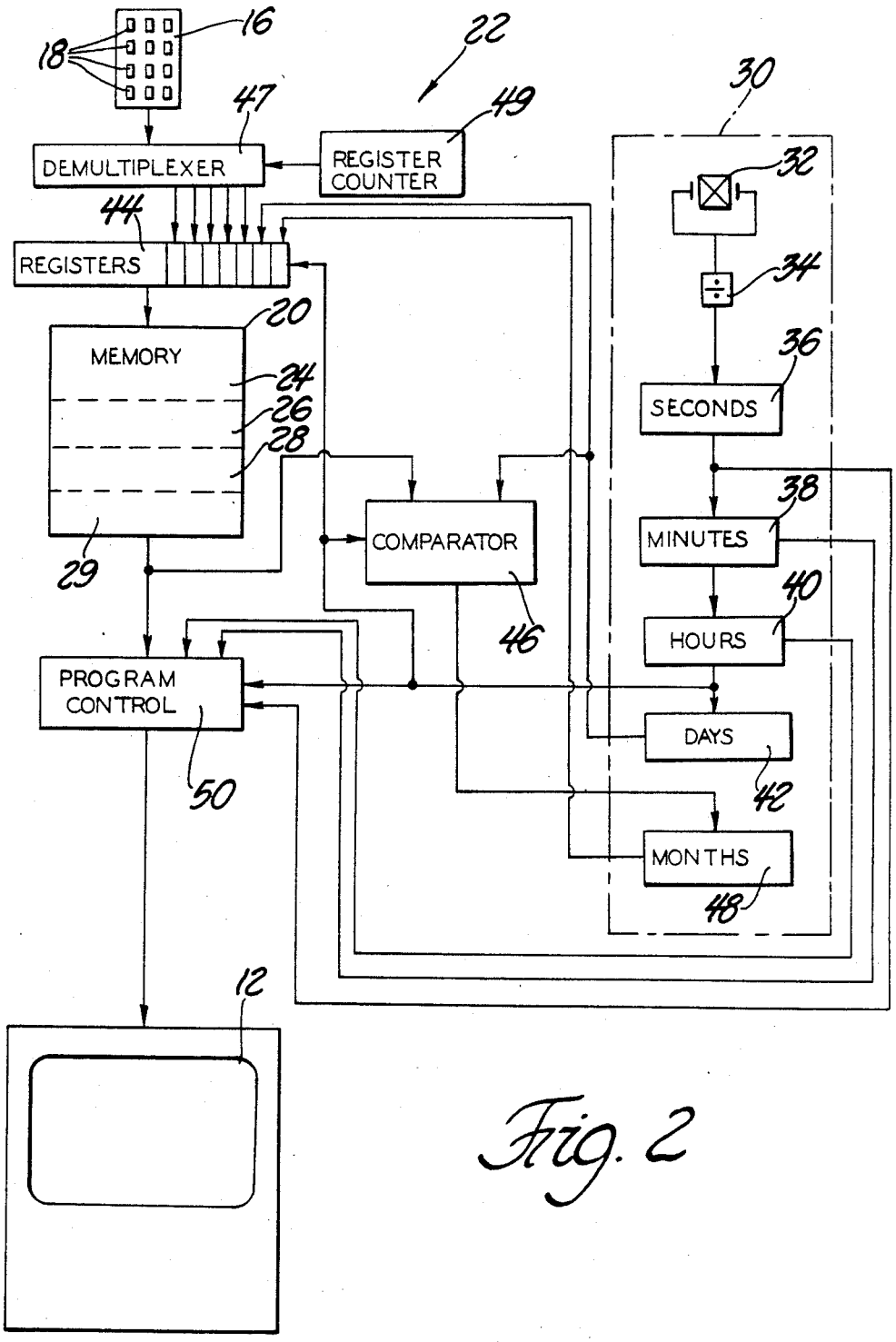

The system 10 includes a video display screen 12, a circuit board 14, and a keyboard 16. The key board 16 contains at least twelve keys 18 for selecting the geographical location indicated by the telephone area code. A conventional keyboard, such as a touch tone keyboard with a telephone, may be used. The video display screen 12 is a CRT (cathode ray tube) screen, of the well known type. The keyboard 16 is electrically connected by wires to the circuit board 14. The circuit board 14 contains a memory means 20 and a control means 22, which are shown in block diagram in FIG. 2. The keyboard 16 is arranged with the control means 22, so a given result occurs when particular keys are pushed, as described subsequent.

The memory means 20 includes a first memory block 24 which contains the sunrise time, sunset time and twilight duration. The first memory block 20 may contain algoryhthms for sunrise time, sunset time and twilight duration as an alternative to storing the exact times for each day. A second block 26 contains by letter code the major city name beginning with that letter and the telephone area code corresponding to the geographical location of the major city name. A third memory block 28 contains by telephone area code minor city names within the area code. A fourth memory block 29 stores the number of days in a month. The memory means 20 can be a ROM (Read Only Memory) of the well known type. The city designation may be the three letter identifiers used by the FAA for the major airport serving the city.

The control means 22 selects the geographical location through the keyboard 16 and retrieves the information from the memory means 20 to generate a signal to the video display screen 12. The control means 22 includes counters 30 which store and update a number representing the present time in seconds, minutes, hours, days, and months. A clock pulse generator 32, such as a crystal, is the means for generating a constant pulse. The pulse is divided by a number so that the output of the divide 34 will send a pulse every second to the seconds counter 36. The seconds counter 36 will generate a pulse of its own after counting sixty pulses from the divider 34. The output pulse from the seconds counter 36 is sent to the minutes counter 38 wherein the minutes counter 38 will send a pulse after receiving sixty pulses from the seconds counter 36. The hours counter 40 receives the output from the minutes counter 38. After receiving twenty four pulses from the minutes counter 38, the hours counter 40 will generate a pulse to the days counter 42. Each time a counter 30 generates its own pulse, the counter 30 is reset to zero to begin counting and incrementing again. When the hours counter 40 generates a signal, it is received by the days counter 42, registers 44, and a comparator 46. The hours counter 40, acts as clear to the registers 44 and an enable to the comparator 46 indicating that a compare function will be done. The days counter 42 will increment upon receiving the signal from the hours counter 40. The months counter 48 is a twelve step counter which indicates the last entire month.

A demultiplexer 47 acts with registers 44 and register counter 49 to accumulate the information from the keyboard and put the bits into registers 44. The registers 44 send this accumulated information to the memory means 20. The memory means 20 includes at least one decoder which interprets the signals from the registers 44 and generates a signal which points to the location in the memory means 20 which indicates the requested functional information. After pointing to the location in memory, the memory means 20 generates a signal to a program control 50.

When the registers 44 receive a clear signal and the program control 50 receives a disable signal from the hours counter 40, the output of the memory means 20 is received by the comparator 46. The information from the memory means 20 includes the number of days in the present month. The comparator 46 will compare the signal from the memory means 20, which indicates the number of days in the month, with the signal from the days counter 42. If the signals are equal, a signal is generated which increments the months counter 48 and resets the days counter 42 to zero. If the signals are not equal, nothing is changed and normal operation resumes.

The registers 44 also receive and utilizes the data from the days and months counters 42, 48 for use during normal operation in the selection of the information from the memory means 20 in relation to the area codes. During normal operation by a user, the registers 44 receive no clear signal from the hours counter 40, but the demultiplexer 47 uses a select signal from the register counter 49. The register counter 49 instructs the demultiplexer 47 in which registers 44 to put the data from the keyboard 16. After a key 18 is touched, the demultiplexer 47 moves this data to one of the registers 44. The register counter 49 increments and puts the next data from a key 18 into a different register 44. The register 44 when completely filled will be read by the memory means 20.

During normal operation, the program control 50 receives the signal from the memory means 20 and from the minutes and hours counters 38, 48. The days counter 42 has not sent a clear signal to the registers 44 nor a disable to the program control 50, thus the program control 50 will generate a signal to the video display screen 12 representative of the selection made on the keyboard 16 and the respective data information.

Figure 1:
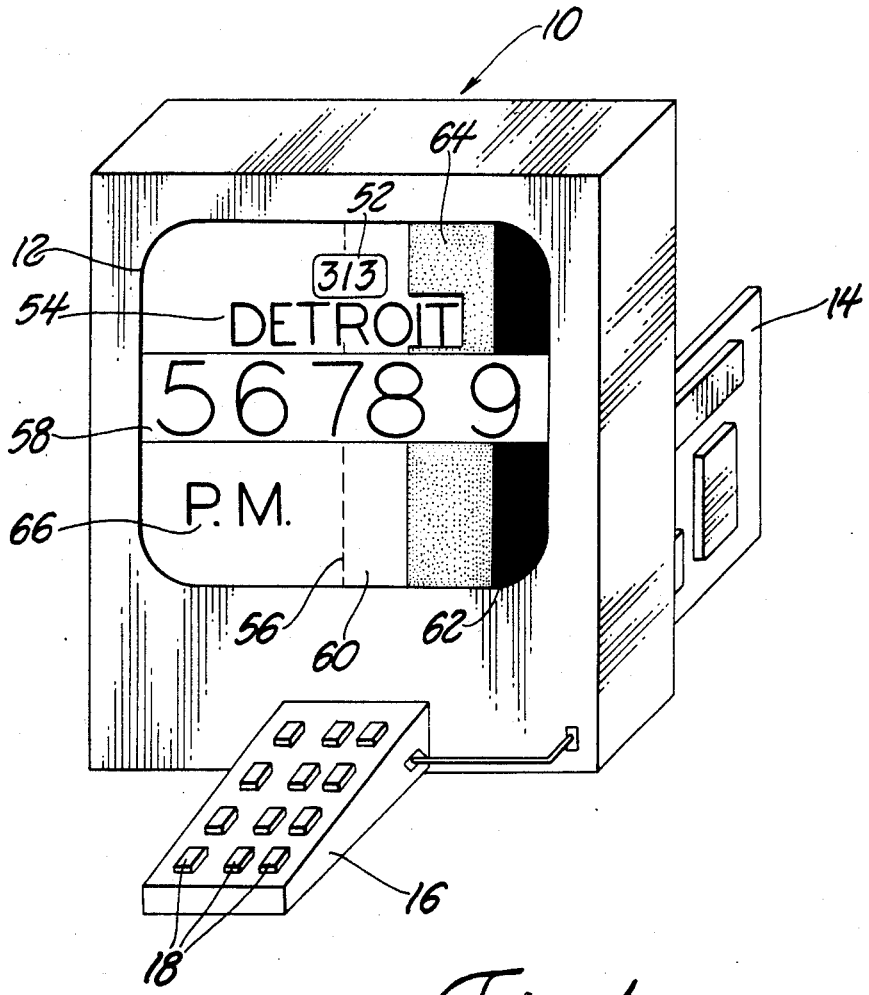

The program control 50 can generate various video displays. A first display is the twilight clock. FIG. 1 shows such a display on the screen 12. The area code 52 and the major city 54 is displayed on the upper portion of the screen 12. A dotted line 56 is located vertically in the center of the screen 12. A band of numbers 58 move from right to left horizontally across the center of the screen 12 which are representative of the hours. A vertical band of light 60, dark 62 and twilight represented by grey 64 will show on the screen 12 when the present hour is approaching sunrise or sunset. The period of day 66 will be indicated on the lower portion of the screen indicating A.M. or P.M. A different day and month and time from the present can be requested through the keyboard. The display will show the light condition for that day and time.

A second display and default display is a circular conventional face clock. During initial start up of the system and when requested through the keyboard 16, the circular face shows the current time with a minute and hour hand.

A third display is an alphabetical directory of major city names. The major city names with their respective telephone area codes and airport abbreviations are displayed by the first letter in the name. The letter is specified through the keyboard 16.

A fourth display is listing of minor city names within an area code. The area code is requested through the keyboard 16.

Several types of keyboards can be adapted to the control means to create an integrated device. For example, as mentioned before, a standard touch tone pad or an ASCII keyboard can be used. The following key sequences may be used with the control means for the desired output.

| KEY SEQUENCE | USER INPUT | RESULT |
|---|---|---|
| # | none | clears registers and displays circular face clock |
| 1 input* | four numbers representing area code | twilight/area code clock |
| 2 input* | five numbers, the first four representing time, the fifth either a 1 for A.M. or 2 for P.M. | use when already within twilight/area code clock as time look ahead |
| 3 input* | four numbers representing: first two, month second two, day | twilight/area code clock with date look ahead |
| 4 input* | four numbers representing area code | listing of minor cities within an area code |
| 5 input* | a letter - since there are three letters per key, the key is punched twice or three times to get the second or third letter | alphabetical directory of major cities with associated area codes |
| 6 input* | 3 letters indicating the airport designation | twilight/area code clock |

To further understand the operation of the subject invention, an example is provided. Pressing the # key is recommended to ensure the registers are cleared, except with time or date look ahead. Assume the key 1 is pushed, the numbers 3,1,3, and then the key * on the keyboard. In short, the sequence of keys pressed is 1,3,1,3,*. This information will be sent to the registers 44 along with the day and month information. The memory means 20 receives the information when the * key is pushed, decodes the information, and points to the location in the memory means 20 where the sunrise time, sunset time, and twilight duration is located for the 313 area code and the specific day and month of the present date. The program control 50 receives this information and generates to the screen 12 the information to present on the screen 12 parallel vertical sections representing juxtaposed hours of the day at the selected geographical location including each of light and dark twilight hours. The display is as shown in FIG. 1. The present hour is 7:00 p.m. and twilight starts at approximately 7:50 p.m. and sunset occurs at approximately 8:00 p.m. The screen is updated every minute.

The preferred embodiment, as described above, is a completely electronically controlled system to indicate time with respect to light conditions in different geographical locations. A second embodiment may employ mechanical tools resulting in a device indicating similar information as the preferred embodiment. The mechanical embodiment includes a cylindrical globe secured above a slightly smaller cylindrical stand. The exterior of the cylindrical globe contains a geographical map with area codes indicated thereon. On the inside of the cylinder, are eleven sheets stacked vertically upon one another adjacent the globe cylinder. A twelfth sheet is on the cylindrical base. There is a notch on the inside of the globe cylinder which aligns with the notch on each of the twelve sheets. The cylindrical base stays stationary while the cylindrical globe and twelve sheets will move together in a rotating motion. Each of the sheets represent a separate month. The number of days are in rows horizontally across the sheets. Vertical columns. align with general longitude lines aligned with their respective area codes on the globe cylinder, creating a matrix on the sheets of day and area code. Each vertical column represents a zone for time and light conditions. Within each block of the matrix is the sunrise time, twilight duration, and sunset time for the selected geographical area and date. Monthly the sheet is changed by removing the sheet from the cylindrical base and by doing so the next month will drop onto the cylindrical base and the previous month is inserted on the top of the globe cylinder.

The invention has been described in an illustrative manner and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. An display system for displaying the daylight conditions of a geographical location, comprising; a display screen (12), memory means (20) storing information including the beginning and ending of twilight at sunrise and sunset for each calendar day of the year for various geographical locations, and control means (22) for selecting a geographical location and retrieving the information from said memory means (20) and for generating a signal to and presenting on said display screen (12) parallel sections (60, 62, 64) of different light intensities representing juxtaposed hours of the day at the selected geographical location including each of light and dark and twilight hours.

2. A system as set forth in claim 1 wherein said system is electronic and said display screen comprises a video screen.

3. A system as set forth in claim 2 wherein said memory means (20) includes a first memory block (24) containing sunrise time, sunset time, and twilight duration.

4. A system as set forth in claim 3 wherein said control means (22) includes a keyboard (16) for manual input of the geographical location for display of respective said sections of light, dark and twilight hours.

5. A system as set forth in claim 4 including a clock pulse generator (32) and wherein said control means (22) includes counter means (30) for storing real time by receiving the signal from a clock pulse generator (32).

6. A system as set forth in claim 5 wherein said counter means (30) includes a plurality of separate but electronically connected binary counters (36, 38, 40, 42, 48) for storing and updating a number representing the present time in seconds, minutes, hours, days, and months respectively.

7. A system as set forth in claim 6 wherein said control means (22) includes a demultiplexer (47), holding registers (44), and a register counter (49) for retrieving signals in response to the input of geographical location by said keyboard (16) and from said counters (42) and (48) for said days and said months and for providing an output to said memory means (20) wherein said memory means decodes the signal to designate the location where the representative information of said sunrise time, said sunset time, and said twilight duration is located.

8. A system as set forth in claim 7 wherein said control means (22) includes a program control (50) which retrieves the signal of information from said memory means (20), from said counters (38, 40) for said minutes and said hours and generates a signal to said display screen for the display of said sections of light (60), dark (62) and twilight (64) hours with respect to present time.

9. A system as set forth in claim 8 wherein said memory means (20) includes a second memory block (26) containing by letter the city name beginning with the letter and telephone area codes corresponding to the geographical location of said city name.

10. A system as set forth in claim 9 wherein said memory means (20) includes a third memory block (28) containing by geographical location represented by telephone area code minor city names within said area code.

11. A system as set forth in claim 10 wherein said memory means (20) includes at least one Read-Only Memory unit (ROM).

12. A system as set forth in claim 11 wherein said control means (22) further includes a comparator (46) electronically connected between the output of said memory means (20) and the output of said days counter (42) for clearing said days counter (42) when the number from said days counter equals the output of said memory means (20) which represents the total number of days in a particular month of any designated year.

13. A system as set forth in claim 12 wherein said display screen is a cathode ray tube screen.

14. A method for displaying the daylight of a geographical location the steps comprising;

storing information of the beginning and ending of the twilight times at sunrise and sunset for each calendar day of the year for various geographical locations in a memory means, selecting a geographical location, retrieving the information from the memory means corresponding to the selected geographical location, and presenting the information on a display screen in parallel sections of different light intensities representing juxtaposed hours of the day at the selected geographical location including each of light and dark and twilight hours.

* * * * *